US007073560B2

(12) United States Patent
Kang et al.

(10) Patent No.: US 7,073,560 B2
(45) Date of Patent: Jul. 11, 2006

(54) FOAMED STRUCTURES OF BULK-SOLIDIFYING AMORPHOUS ALLOYS

(76) Inventors: James Kang, 8 Carmel Woods, Laguna Niguel, CA (US) 92677; William L. Johnson, 3546 Mountainview Ave., Pasadena, CA (US) 91107; Atakan Peker, 17 Coffeeberry, Aliso Viejo, CA (US) 92656; Jan Schroers, 350 Oak St, Laguna Beach, CA (US) 92651

( * ) Notice: Subject to any disclaimer, the term of this patent is extended or adjusted under 35 U.S.C. 154(b) by 0 days.

(21) Appl. No.: 10/442,707

(22) Filed: May 20, 2003

(65) Prior Publication Data

US 2004/0035502 A1 Feb. 26, 2004

Related U.S. Application Data

(60) Provisional application No. 60/381,938, filed on May 20, 2002.

(51) Int. Cl.
*B22D 27/00* (2006.01)

(52) U.S. Cl. ..... 164/79; 148/403

(58) Field of Classification Search ..... 164/79; 148/403

See application file for complete search history.

(56) References Cited

U.S. PATENT DOCUMENTS 3,773,098 A * 11/1973 Rock ..... 164/79
3,989,517 A 11/1976 Tanner et al.
4,050,931 A 9/1977 Tanner et al.
4,064,757 A 12/1977 Hasegawa
4,067,732 A 1/1978 Ray
4,113,478 A 9/1978 Tanner et al.
4,116,682 A 9/1978 Polk et al.
4,116,687 A 9/1978 Hasegawa
4,126,449 A 11/1978 Tanner et al.
4,135,924 A 1/1979 Tanner et al.
4,148,669 A 4/1979 Tanner et al.
4,623,387 A 11/1986 Masumoto et al.
4,721,154 A 1/1988 Christ et al.
4,743,513 A 5/1988 Scruggs
4,987,033 A 1/1991 Abkowitz et al.
4,990,198 A 2/1991 Masumoto et al.
5,032,196 A 7/1991 Masumoto et al.
5,053,084 A 10/1991 Masumoto et al.
5,053,085 A 10/1991 Masumoto et al.
5,213,148 A 5/1993 Masumoto et al.
5,250,124 A 10/1993 Yamaguchi et al.
5,279,349 A 1/1994 Horimura
5,281,251 A * 1/1994 Kenny et al. ..... 75/415
5,288,344 A 2/1994 Peker et al.
5,368,659 A 11/1994 Peker et al.
5,380,375 A 1/1995 Hashimoto et al.
5,384,203 A * 1/1995 Apfel ..... 428/613

(Continued)

OTHER PUBLICATIONS

Hasegawa et al., "Superconducting Properties of Be-Zr Glassy Alloys Obtained by Liquid Quenching," Physical Review B, Nov. 1, 1977, vol. 16, No. 9, pp. 3925-3928.

(Continued)

*Primary Examiner*—Kuang Y. Lin
(74) *Attorney, Agent, or Firm*—Christie, Parker & Hale, LLP

(57) ABSTRACT

A foamed structure of bulk solidifying amorphous alloy with improved impact resistance, with high stiffness to weight ratio, and/or with high resistance to fatigue and crack propagation, and a method for forming such foamed structures are provided.

41 Claims, 3 Drawing Sheets

U.S. PATENT DOCUMENTS

| | | | | |
|---|---|---|---|---|
| 5,449,425 | A | 9/1995 | Renard et al. | |
| 5,482,580 | A | 1/1996 | Scruggs et al. | |
| 5,567,251 | A | 10/1996 | Peker et al. | |
| 5,711,363 | A | 1/1998 | Scruggs et al. | |
| 5,797,443 | A | 8/1998 | Lin et al. | |
| 5,865,237 | A * | 2/1999 | Schorghuber et al. | 164/79 |
| 5,896,642 | A | 4/1999 | Peker et al. | |
| 5,950,704 | A | 9/1999 | Johnson et al. | |
| 6,021,840 | A | 2/2000 | Colvin | |
| 6,027,586 | A | 2/2000 | Masumoto et al. | |
| 6,044,893 | A | 4/2000 | Taniguchi et al. | |
| 6,200,685 | B1 | 3/2001 | Davidson | |
| 6,258,183 | B1 | 7/2001 | Onuki et al. | |
| 6,306,228 | B1 | 10/2001 | Inoue et al. | |
| 6,371,195 | B1 | 4/2002 | Onuki et al. | |
| 6,376,091 | B1 | 4/2002 | Croopnick | |
| 6,408,734 | B1 | 6/2002 | Cohen | |
| 6,408,928 | B1 * | 6/2002 | Heinrich et al. | 164/46 |
| 6,446,558 | B1 | 9/2002 | Peker et al. | |
| 2001/0052406 | A1 | 12/2001 | Kubota et al. | |
| 2002/0036034 | A1 | 3/2002 | Xing et al. | |
| 2002/0050310 | A1 | 5/2002 | Kundig et al. | |
| 2003/0051850 | A1 * | 3/2003 | Asholt et al. | 164/79 |

OTHER PUBLICATIONS

Inoue et al., "Effect of Additional Elements on Glass Transition Behavior and Glass Formation Tendency of Zr-Al-Cu-Ni Alloys," Materials Transactions, Japan Institute of Metals, 1995, vol. 35, No. 12, pp. 1420-1426.

Inoue et al., "Fabrication of Bulky Zr-Based Glassy Alloys by Suction Casting into Copper Mold," Materials Transactions, Japan Institute of Metals, 1995, vol. 36, No. 9, pp. 1184-1187.

Inoue et al., "High Strength Bulk Amorphous Alloys with Low Critical Cooling Rates (Overview)," Materials Transactions, Japan Institute of Metals, 1995, vol. 36, No. 7, pp. 866-875.

Inoue et al., "Preparation of Bulky Amorphous Zr-Al-Co-Ni-Cu Alloys by Copper Mold Casting and Their Thermal and Mechanical Properties," Materials Transactions, Japan Institute of Metals, 1995, vol. 36, No. 3, pp. 391-398.

Inoue et al., "Preparation of 16 mm Diameter Rod of Amorphous $Zr_{65}Al_{7.5}Ni_{10}Cu_{17.5}$ Alloy," Materials Transactions, Japan Institute of Metals, 1993, vol. 35, No. 12, pp. 1234-1237.

Inoue et al., "Solidification Analyses of Bulky $Zr_{60}Al_{10}Ni_{10}Cu_{15}Pd_5$ Glass Produced by Casting into Wedge-Shape Copper Mold," Materials Transactions, Japan Institute of Metals, 1995, vol. 36, No. 10, pp. 1276-1281.

Inoue et al., "Zr-Al-Ni Amorphous Alloys with High Glass Transition Temperature and Significant Supercooled Liquid Region," Materials Transactions, Japan Institute of Metals, 1990, vol. 31, No. 3, pp. 117-183.

Jost et al., "The Structure of Amorphous Be-Ti-Zr Alloys," Zeitschrift fur Physikalische Chemie Neue Folge Bd., 1988, pp. 11-15.

Maret et al., "Structural Study of $Be_{43}Hf_xZr_{57-x}$ Metallic Glasses by X-ray and Neutron Diffraction," Journal De Physique, 1986, vol. 47, No. 5, pp. 863-871.

Rabinkin et al., "Amorphous Ti-Zr—Base Metglas Brazing Filler Metals," Scripta Metallurgica et Materialia, 1991, vol. 25, pp. 399-404.

Rizzo, H. F. et al., "Formation and Stability of Metastable Structures and Amorphous Phases in PU-V, PU-TA and PU-YB Systems With Positive Heats of Mixing," Metallurgical and Materials Transactions, vol. 25A, No. 8, Aug. 1994, pp. 1579-1590.

Tabachnikova, E. D. et al., "Low Temperature Ductile Shear Failure of $Zr_{41.2}Ti_{13.8}Ni_{10}Cu_{12.5}Be_{22.5}$ and Cu50Zr35Ti8Hf5Ni2 Bulk Amorphous Alloys," Materials Science Forum vols. 343-346, (2000) pp. 197-202; Journal of Metastable and Nanocrystalline Materials vol. 8 (2000), pp. 197-202; 2000 Trans Tech Publications, Switzerland.

Tanner et al., "Metallic Glass Formation and Properties in Zr and Ti Alloyed with Be-I the Binary Zr-Be and Ti-Be Systems," Acta Metallurgica, 1979, vol. 27, pp. 1727-1747.

Tanner, L.E., "Physical Properties of Ti-Be-Si Glass Ribbons," Acta Metallurgica, 1978, vol. 12, pp. 703-708.

Tanner et al., "Physical Properties of $Ti_{50}Be_{40}Zr_{10}$ Glass," Scripta Metallurgica, 1978, vol. 11, pp. 783-789.

Tanner, L.E., "The Stable and Metastable Phase Relations in the Hf-Be Alloy System," Acta Metallurgica, 1980, vol. 28, pp. 1805-1816.

Zhang et al., "Amorphous Zr-Al-TM (TM=Co, Ni, Cu) Alloys with Significant Supercooled Liquid Region of Over 100 K," Materials Transactions, Japan Institute of Metals, 1991, vol. 32, No. 11, pp. 1005-1010.

PCT International Search Report dated Jan. 27, 2004, from corresponding International Application PCT/US03/15957 filed May 20, 2003.

Barnhart, J., "Manufacture, Characterisation and Application of Cellular Metals and Metal Foams", Progress in materials Science, vol. 46, 2001, pp. 559-632.

Qiu et al., "Rapid Decompression of Seeded Melts for Materials Processing", Rev. Sci. Instrum., vol. 66, No. 5, May 1995, pp. 3337-3343.

European Search Report for Application No. 03729048.3-2122 dated Oct. 11, 2005, 3 pages.

* cited by examiner

FOAMED STRUCTURES OF BULK-SOLIDIFYING AMORPHOUS ALLOYS

CROSS-REFERENCE TO RELATED APPLICATION

This application is based on and claims priority to Provisional U.S. Application No. 60/381,938, filed May 20, 2002.

FIELD OF THE INVENTION

The present invention relates to articles comprising foamed structures of bulk-solidifying amorphous alloys, and methods of forming and shaping such articles.

BACKGROUND OF THE INVENTION

Bulk solidifying amorphous alloys are a recently discovered family of amorphous alloys, which have a number of physical attributes that make them highly useful in a wide range of applications. For example, bulk solidifying amorphous alloys can sustain strains up to 1.5% or more without any permanent deformation or breakage. Furthermore, they have a high fracture toughness of 10 ksi-sqrt(in) (sqrt: square root) or more, and preferably 20 ksi sqrt(in) or more. Also, they have high hardness values of 4 GPa or more, and in some formulations as high as 5.5 GPa or more. The yield strength of bulk solidifying alloys ranges from 1.6 GPa and reaches up to 2 GPa and more exceeding the current state of the Titanium alloys. Furthermore, the above bulk amorphous alloys have a density in the range of 4.5 to 6.5 g/cc, as such they provide high strength to weight ratios. In addition to desirable mechanical properties, bulk solidifying amorphous alloys also have very good corrosion resistance.

However, bulk-solidifying amorphous alloys have a few short comings as well. Generally, amorphous alloys have lower Young (and shear) Modulus compared to their crystalline counterparts. For example, Ti-base amorphous alloys typically have a modulus 10 to 25% lower than the leading Ti-base alloys. As such the stiffness to weight ratio of bulk amorphous alloys is not favorable, and as such limits the use and application of such alloys in designs where stiffness is the primary factor. Another shortcoming of amorphous alloys is the limited toughness and energy absorption capability of these materials which reduces their resistance to impacts, especially when their thickness exceeds 2 mm or more. Still another shortcoming of amorphous alloys is a lack of resistance to crack propagation, which substantially reduces the fatigue life of amorphous alloys.

Accordingly, a need exists for improved formulations of bulk solidifying amorphous alloys having improved physical properties.

SUMMARY OF THE INVENTION

The present invention is directed to a foamed structure of bulk solidifying amorphous alloy with improved impact resistance, with high stiffness to weight ratio, and/or with high resistance to fatigue and crack propagation.

In another embodiment, the invention is directed to a method for forming such foamed structures. In one such embodiment the invention is directed to a method for shaping such foamed structures into near-to-net shape articles.

BRIEF DESCRIPTION OF THE DRAWINGS

These and other features and advantages of the invention will be apparent from the following detailed description, appended claims, and accompanying drawings, in which:

DETAILED DESCRIPTION OF THE INVENTION

The present invention is directed to foam structures of bulk solidifying amorphous alloys, which show substantial improvement, compared to the monolithic solid form of the base amorphous alloy, in one or more of the following characteristics: Specific Modulus, Specific Strength, better energy absorption upon impact, higher elastic strain limit, fracture toughness and resistance to crack propagation.

Figure 1A:
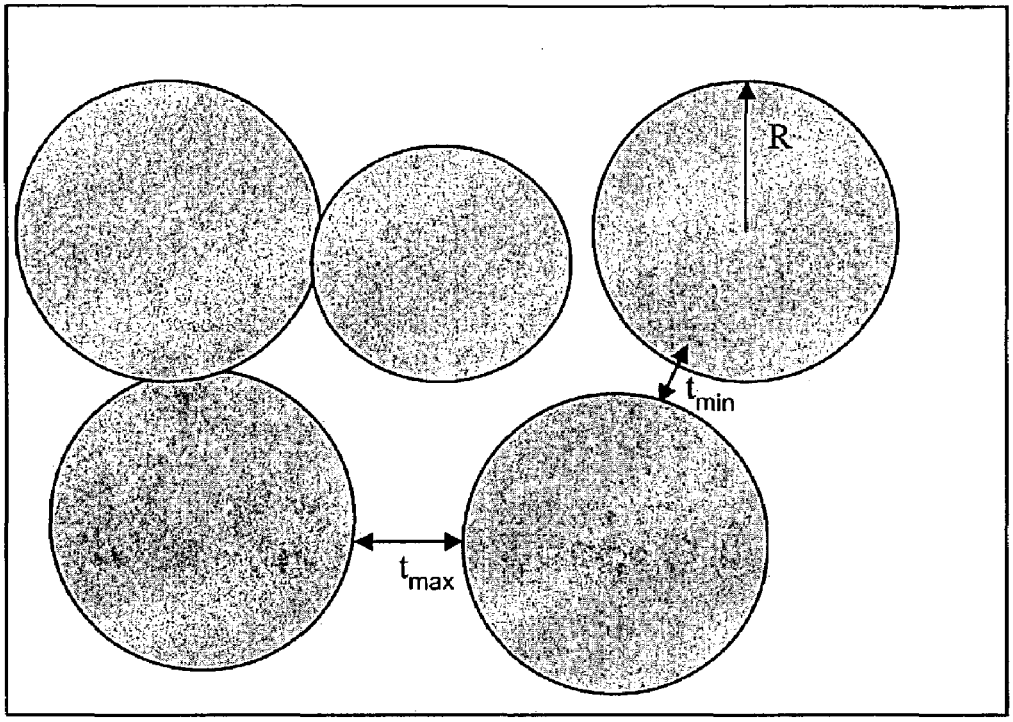
FIG. 1*a* is a schematic of an exemplary "closed-cell" foam structure according to the present invention.
Figure 1B:
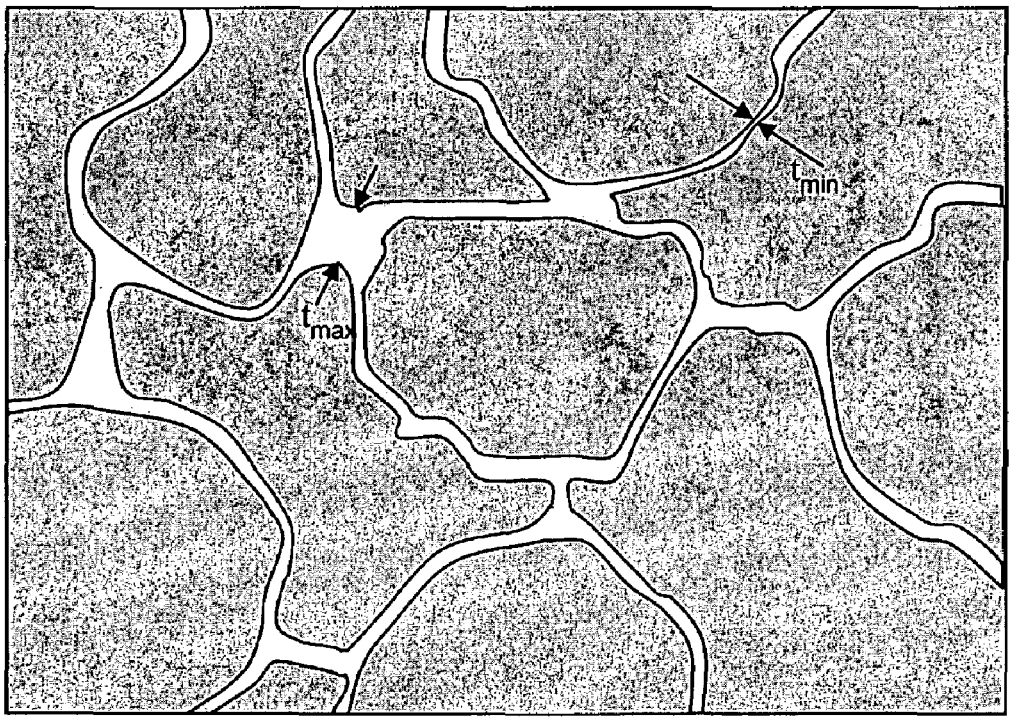
FIG. 1*b* is a schematic of an exemplary "open-cell" foam structure according to the present invention.

Such above improvements are achieved by forming a foam structure wherein, a continuous piece of amorphous alloy is connected through a pore structure. Herein, the pores are either connected to each other throughout and called an "open cell-structure", as shown schematically in FIG. 1*a,* or each pore is fully surrounded by a portion of the continuous piece of amorphous alloy and is called "closed-cell structure", as shown schematically in FIG. 1*b*.

The foam structure is such that porosity and bubbles are formed in certain shapes and volume fractions. Generally the pore size is from 1 micron to up to 1.0 mm in size and the volume fraction of pores is from 10% to up to 95% or more. In some cases, such as foam structures with a high volume fraction of pores or foam structures with "open cell-structure" the pore size can be up to 5 mm in diameter or more.

The size of the body member of the amorphous alloy defining the foam structure (the foam structure itself defined as the size, shape, connectedness and distribution of the pores) plays a critical role in achieving the above-mentioned improvements, particularly in the case of energy absorption, fracture toughness, and resistance to crack propagation. In general, the dimensions of the amorphous body member comprising the foam structure is such that the section thickness of bulk solidifying amorphous is less than 2.0 mm, preferably less than 1.0 mm, and most preferably less than 250 microns.

In one embodiment of the invention, the weight of the amorphous alloy portion of a foam structure body member having a thickness no more than 2.0 mm comprises no more than 50% of the total weight of the amorphous alloy, preferably no more 20% of the total weight of the amorphous alloy, and most preferably no more 5% of the total weight of the amorphous alloy. In another embodiment of the invention, the weight of the amorphous alloy portion of a foam structure body member having a thickness no more than 1.0 mm comprises no more than 50% of the total weight of the amorphous alloy, preferably no more 20% of the total weight of the amorphous alloy, and most preferably no more 5% of the total weight of the amorphous alloy. In still another embodiment of the invention, the weight of the amorphous alloy portion of a foam structure body member with a thickness no more than 0.25 mm comprises no more than 50% of the total weight of the amorphous alloy, preferably no more 20% of the total weight of the amorphous alloy, and most preferably no more 5% of the total weight of the amorphous alloy. Herein, the thickness is defined as the minimum dimension in any cross-section of the solid portion of a bulk amorphous alloy body member.

In the above described foamed structures, the volume fraction of pores is in the range of 20 to 95%. In such forms, the effective toughness and energy absorption capability of bulk-solidifying amorphous alloys is greatly improved. The geometric dependence of fracture toughness as well as ductility of bulk amorphous alloys is utilized to improve the properties.

In one embodiment of the invention, bulk-solidifying amorphous alloy is in such foam structure that the pore size is typically larger than 250 micron. The pore shape is a closed ellipsoidal and preferably spherical. The size of the pore (herein defined by the radius of the sphere) is preferably larger than the critical crack size as calculated by the relation between the fracture toughness, yield strength and critical crack size as given in standard fracture mechanics textbook. The volume fraction of such large spherical pores is in the range of 5 to 50% and preferably from 10 to 30%. In another embodiment of the invention, the volume fraction of the pores is in the range of from 40 to 70%. In such forms, sharp-edged fatigue cracks will be attracted to rounded pores, and the sharp edge of the cracks will be terminated. This will effectively blunt the sharp fatigue cracks and improve the fatigue life of the foamed bulk amorphous alloy structure. Such forms will thereby improve the resistance of bulk-solidifying amorphous alloys to against crack propagation and fatigue.

In another embodiment of the invention, the bulk-solidifying amorphous alloy is in such a foamed structure that the pore size is typically larger than 20 micron. The pore shape is a closed ellipsoidal and preferably spherical. The volume fraction of such spherical pores is in the range of 20 to 90%, and preferably from 50 to 80%. In one embodiment of the invention, the foam structure is such that the pore shape is spherical and the volume fraction is in the range of 20% to 70%, and preferably in the range of from 40% to 60%. In such forms of the bulk-solidifying amorphous alloys, the effective stiffness to weight ratio will be substantially improved.

In another embodiment of the invention, the bulk-solidifying amorphous alloy is in such a foamed structure that the pore size is typically less than 10 micron and preferably less than 5 micron. The pore shape is a closed ellipsoidal and preferably spherical. The volume fraction of such pores is in the range of 20 to 90%, and preferably from 50 to 80%. In one embodiment of the invention, the foam structure is such that the pore shape is spherical and the volume fraction is in the range of 20% to 70%, and preferably in the range of from 40% to 60%. In such forms of the bulk-solidifying amorphous alloys, the effective stiffness to weight ratio will be substantially improved.

In another embodiment of the invention, the bulk-solidifying amorphous alloy is in such a foamed structure that the pore structure is open and continuously percolating as typical in an open-cellular structure. The volume fraction of such open pores is in the range of 40 to 95%, and preferably from 70 to 90%. In such forms of the bulk-solidifying amorphous alloys, the effective stiffness to weight ratio will be greatly improved. Furthermore, in such structures, a foam material with a higher elastic strain limit than the base amorphous alloy can be achieved.

In another embodiment of the invention, the articles of such foam structures of bulk-solidifying amorphous alloy have a solid thin shell on the outer surface of such articles. The thickness of the solid surface shell is less than 2.0 mm, and preferably less than 1.0 mm, and most preferably less than 0.5 mm. Preferably, the solid thin shell itself is one continuous piece covering the whole outer surface. In one embodiment of the invention, the solid thin shell covers two opposite faces of the foam article. Furthermore, in one preferred embodiment the outer shell has a metallurgical bond to the amorphous alloy foam body.

Turning now to the composition of these foamed structures, bulk solidifying amorphous alloys are a recently discovered family of amorphous alloys, which can be cooled at about 500 K/sec or less, and substantially retain their amorphous atomic structure. As such, they can be produced in thicknesses of 1.0 mm or more, substantially thicker than conventional amorphous alloys, which have thicknesses of about 0.020 mm, and which require cooling rates of $10^5$ K/sec or more. U.S. Pat. Nos. 5,288,344; 5,368,659; 5,618,359; and 5,735,975 (the disclosures of which are incorporated herein by reference) disclose such bulk solidifying amorphous alloys.

One exemplary family of bulk solidifying amorphous alloys can be described by the formula $(Zr,Ti)_a(Ni,Cu,Fe)_b(Be,Al,Si,B)_c$, where a is in the range of from 30 to 75, b is in the range of from 5 to 60, and c in the range of from 0 to 50 in atomic percentages. A preferable alloy family is $(Zr,Ti)_a(Ni,Cu)_b(Be)_c$, where a is in the range of from 40 to 75, b is in the range of from 5 to 50, and c in the range of from 5 to 50 in atomic percentages. Still, a more preferable composition is $(Zr,Ti)_a(Ni,Cu)_b(Be)_c$, where a is in the range of from 45 to 65, b is in the range of from 7.5 to 35, and c in the range of from 10 to 37.5 in atomic percentages. Another preferable alloy family is $(Zr)_a(Nb,Ti)_b(Ni,Cu)_c(Al)_d$, where a is in the range of from 45 to 65, b is in the range of from 0 to 10, c is in the range of from 20 to 40 and d in the range of from 7.5 to 15 in atomic percentages.

Furthermore, those alloys can accommodate substantial amounts of other transition metals up to 20% atomic, and more preferably metals such as Nb, Cr, V, Co.

Another set of bulk-solidifying amorphous alloys are ferrous metal based compositions (Fe, Ni, Co). Examples of such compositions are disclosed in U.S. Pat. No. 6,325,868, and publications to (A. Inoue et. al., Appl. Phys. Lett., Volume 71, p 464 (1997)), (Shen et. al., Mater. Trans., JIM, Volume 42, p 2136 (2001)), and Japanese patent application 2000126277 (Publ. #0.2001303218 A). One exemplary composition of such alloys is $Fe_{72}Al_5Ga_2P_{11}C_6B_4$. Another exemplary composition of such alloys is $Fe_{72}Al_7Zr_{10}Mo_5W_2B_{15}$. Although, these alloy compositions are not processable to the degree of the Zr-base alloy systems, they can be still be processed in thicknesses around 1.0 mm or more, sufficient enough to be utilized in the current invention. In addition, although their density is generally higher, from 6.5 g/cc to 8.5 g/cc, their yield strength is also higher, ranging from 2.5 GPa to 4 GPa or more making them particularly attractive in some high stress applications. Similarly, they have elastic strain limit higher than 1.2% and generally about 2.0% Ferrous metal-base bulk amorphous alloys also have very high yield hardnesses ranging from 7.5 GPA to 12 GPa.

In general, crystalline precipitates in bulk amorphous alloys are highly detrimental to the properties of bulk solidifying amorphous alloys, especially to toughness and strength, and as such it is generally preferred to minimize the volume fraction of these precipitates as much as possible.

However, there are cases in which, ductile crystalline phases precipitate in-situ during the processing of bulk amorphous alloys, which are indeed beneficial to the properties of bulk amorphous alloys especially to the toughness and ductility. Such bulk amorphous alloys comprising such beneficial precipitates are also included in the current invention. One exemplary case is disclosed in (C. C. Hays et. al, Physical Review Letters, Vol. 84, p 2901, 2000, the disclosure of which is incorporated herein by reference.

Figure 2:
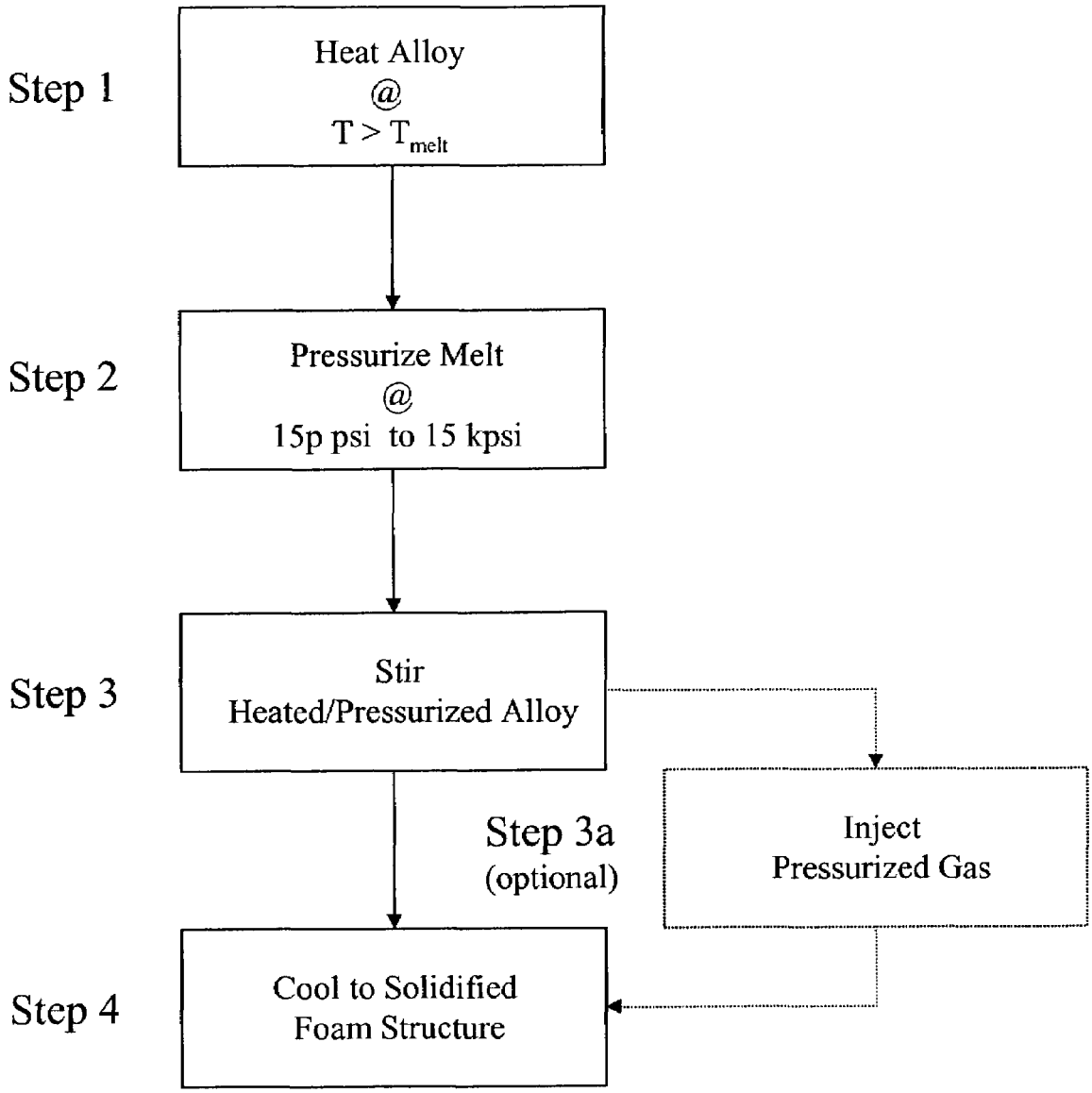
FIG. 2 is a flow-chart of an exemplary embodiment of a method for forming the foamed bulk solidifying amorphous alloy structures according to the present invention.

The invention is also directed to methods of forming the foamed structures described above. In one particular embodiment of the method, the steps of which are outlined in FIG. 2, a feedstock bulk-solidifying amorphous alloy is heated to a temperature above the melting temperature to form a molten bulk solidifying amorphous alloy (defined as the melting temperature of the corresponding crystalline phase for the given composition). In such an embodiment, the feedstock of the alloy is not necessarily in an amorphous atomic structure. This molten bulk solidifying amorphous alloy is then pressurized. In such a step the pressure can be from 15 psi to up to 15,000 psi. The pressurized molten alloy is then rapidly stirred to form and trap bubbles. The stirring tool is a refractory tool such as made of graphite, carbide (WC, BC), nitrides, other refractory such as Zirconia or refractory metals such as tungsten and molybdenum The stirring tool is typically in the shape of propeller and spun at rates of from 30 rpm to 1200 rpm. The spinning rate can be up to 5,000 rpm or more in order to achieve a higher volume fraction of pore, more than about 30%. The rate of spinning can be adjusted to get the desired size pore (bubble) size and distribution. Finally, the mixture of bubble and molten alloy is cooled below the glass transition temperature of the amorphous alloy to freeze the bubbles into a solidified foam structure. As discussed above, a cooling rate faster than the critical cooling rate of the amorphous alloy is desired in order to ensure the formation of amorphous atomic structure substantially throughout the structure. In such an embodiment, the cooling may be achieved by external means such utilizing a massive cold substrate or convection gas cooling.

In one optional embodiment of the invention, the foamed structure is formed under a high ambient pressure, such as 1 kpsi to 10 kpsi or more, to form smaller size pores. Then the formed structure is cast into shape with the release of the ambient pressure such that the pore size grows to the desired range. The casting operation can be optionally done in a closed die-cavity to form individual articles. Alternatively, the casting can be done in an open-die cavity to produce continuous or semi-continuous articles such as in the shape of plates, rods, etc.

In another optional embodiment, while stirring, a gas line can be inserted into the molten body, such that additional bubbles can be generated. In such an embodiment, the pressure of the gas line is higher than the pressure the molten body is subjected to. The gas is preferably an inert gas such as Argon, Helium and in certain cases Nitrogen.

Figure 3:
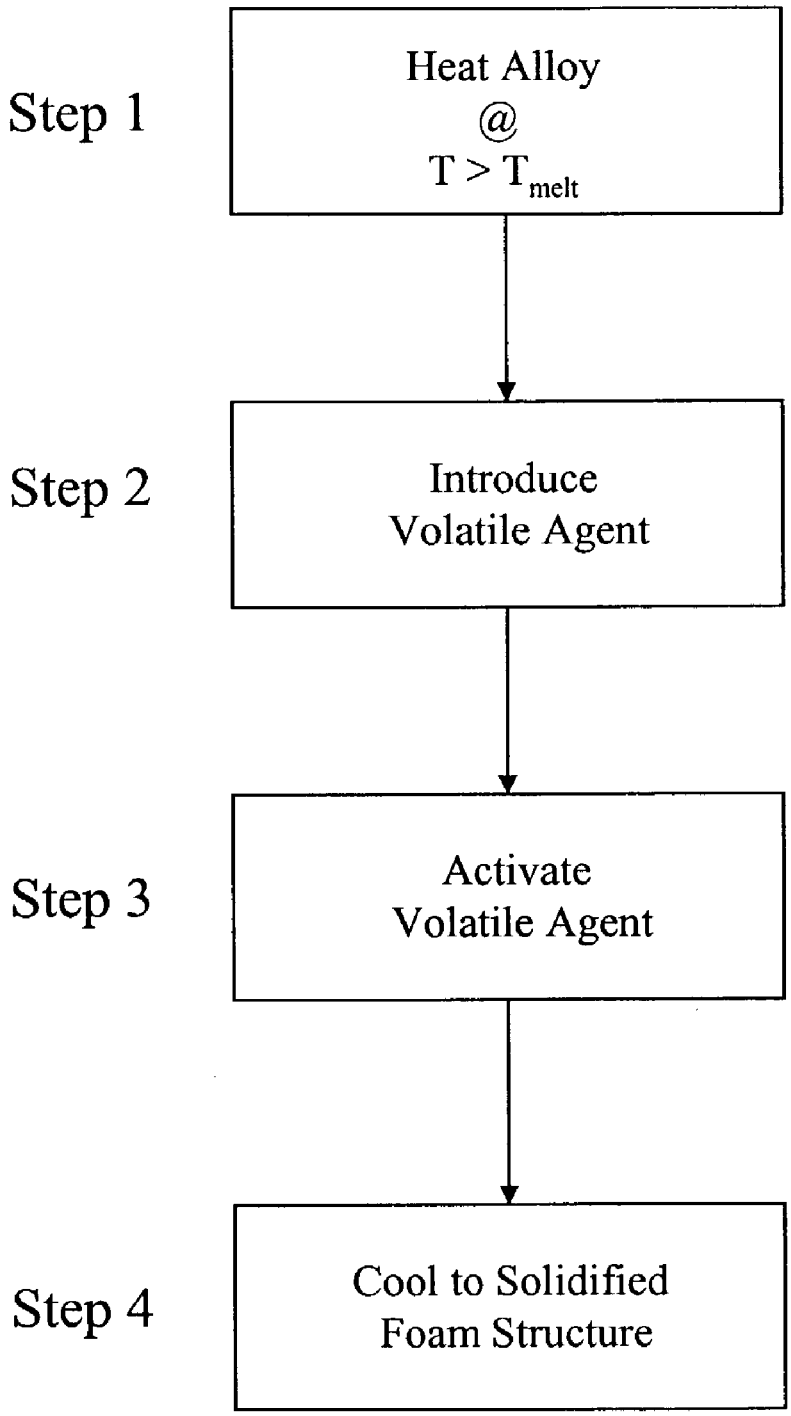
FIG. 3 is a flow-chart of another exemplary embodiment of a method for forming the foamed bulk solidifying amorphous alloy structures according to the present invention.

In another embodiment of a method of forming such structures, as outlined in the flow-chart provided in FIG. 3, a fugitive or volatile agent is utilized to form the desired shape and size of the pores. One preferred form of such agents are hydrites such as ZrH and TiH. In this method, the amorphous alloy is again heated to a temperature above the melting temperature. The fugitive agent is then introduced into the molten body of the alloy. The volatility of the fugitive agent is activated by increasing the melt temperature or by other means such as using mechanical stirring or assistance. Accordingly, the fugitive agent assists in the formation of pores in the melt. The melt is then subsequently cooled below the glass transition temperature of the amorphous alloy.

The present invention is also directed to a method of a shaped article of foamed bulk amorphous alloy structure. In this embodiment of the invention a feedstock of a foamed bulk solidifying amorphous alloy structure is provided, which can be produced by one of the above mentioned methods. The feedstock material is then heated to about the glass transition temperature or above. At this temperature the bulk amorphous alloy with the foamed structure can be shaped into net-shape articles in a suitable molding and thermo-plastic process, while preserving its underlying foam structure substantially. A variety of molding operations can be utilized such as blow molding (where a portion of the feedstock material is clamped and a pressure difference is applied on opposite faces of the unclamped area), die-forming (where the feedstock material is forced into a die cavity), and replication of surface features (where the feedstock is forced into a replicating die). U.S. Pat. Nos. 6,027,586; 5,950,704; 5,896,642; 5,324,368; and 5,306,463 (the disclosures of which are incorporated herein by reference) disclose methods of forming molded articles of amorphous alloys exploiting their processability at around the glass transition temperature.

Although subsequent processing steps may be used to finish the amorphous alloy articles of the current invention, it should be understood that the mechanical properties of the bulk amorphous alloys can be obtained in the as cast and/or molded form without any need for subsequent processing, such as heat treatment or mechanical working.

Finally, although only pure bulk solidifying amorphous alloys are described above, in one embodiment, composites of bulk amorphous alloys, including composite materials such as conventional metals and refractory materials can also be formed into the foamed structures described herein using the methods of the current invention.

Although specific embodiments are disclosed herein, it is expected that persons skilled in the art can and will design alternative foamed bulk solidifying amorphous alloy structures and methods to produce such foamed bulk solidifying amorphous alloy structures that are within the scope of the following claims either literally or under the Doctrine of Equivalents.

What is claimed is:

1. A solidified foam bulk amorphous alloy structure comprising a foam structure of a bulk solidifying amorphous alloy having a critical cooling rate at about 500 K/sec or less wherein a continuous piece of the bulk solidifying amorphous alloy is connected through a pore structure comprising a plurality of pores and wherein the size of each pore is from 1 micron to up to 5.0 mm in size and the volume fraction of the plurality of pores is from 10% to up to 95% or more such that the solidified foam bulk amorphous alloy structure is superior to the monolithic solid form of the base bulk solidifying amorphous alloy in at least one of the characteristics selected from the group consisting of specific modulus, specific strength, elastic strain limit, energy absorption, fracture toughness, and crack propagation resistance.

2. The solidified foam bulk amorphous alloy structure described in claim 1, wherein the plurality of pores are connected to each other throughout to form an open cell-structure.

3. The solidified foam bulk amorphous alloy structure described in claim 1, wherein the plurality of pores are each fully surrounded by a portion of the continuous piece of amorphous alloy to form a closed-cell structure.

4. The solidified foam bulk amorphous alloy structure described in claim 1, wherein the solidified foam bulk amorphous alloy structure forms an amorphous body member, and wherein the thickness of the bulk solidifying amorphous alloy is less than 2.0 mm.

5. The solidified foam bulk amorphous alloy structure described in claim 1, wherein the solidified foam bulk amorphous alloy structure forms an amorphous body member, and wherein the thickness of the bulk solidifying amorphous alloy is less than 1.0 mm.

6. The solidified foam bulk amorphous alloy structure described in claim 1, wherein the solidified foam bulk amorphous alloy structure forms an amorphous body member, and wherein the thickness of the bulk solidifying amorphous alloy is less than 250 microns.

7. The solidified foam bulk amorphous alloy structure described in claim 4, wherein the weight of the bulk solidifying amorphous alloy in the solidified foam bulk amorphous alloy structure comprises no more than 50% of the total weight of the amorphous body member.

8. The solidified foam bulk amorphous alloy structure described in claim 4, wherein the weight of the bulk solidifying amorphous alloy in the solidified foam bulk amorphous alloy structure comprises no more than 20% of the total weight of the amorphous body member.

9. The solidified foam bulk amorphous alloy structure described in claim 4, wherein the weight of the bulk solidifying amorphous alloy in the solidified foam bulk amorphous alloy structure comprises no more than 5% of the total weight of the amorphous body member.

10. The solidified foam bulk amorphous allay structure described in claim 5, wherein the weight of the bulk solidifying amorphous alloy in the solidified foam bulk amorphous alloy structure comprises no more than 50% of the total weight of the amorphous body member.

11. The solidified foam bulk amorphous alloy structure described in claim 5, wherein the weight of the bulk solidifying amorphous alloy in the solidified foam bulk amorphous alloy structure comprises no more than 20% of the total weight of the amorphous body member.

12. The solidified foam bulk amorphous alloy structure described in claim 5, wherein the weight of the bulk solidifying amorphous alloy in the solidified foam bulk amorphous alloy structure comprises no more than 5% of the total weight of the amorphous body member.

13. The solidified foam bulk amorphous alloy structure described in claim 6, wherein the weight of the bulk solidifying amorphous alloy in the solidified foam bulk amorphous alloy structure comprises no more than 50% of the total weight of the amorphous body member.

14. The solidified foam bulk amorphous alloy structure described in claim 6, wherein the weight of the bulk solidifying amorphous alloy in the solidified foam bulk amorphous alloy structure comprises no more than 20% of the total weight of the amorphous body member.

15. The solidified foam bulk amorphous alloy structure described in claim 6, wherein the weight of the bulk solidifying amorphous alloy in the solidified foam bulk amorphous alloy structure comprises no more than 5% of the total weight of the amorphous body member.

16. The solidified foam bulk amorphous alloy structure described in claim 1, wherein the volume fraction of the plurality of pores is in the range of 20 to 95%.

17. The solidified foam bulk amorphous alloy structure described in claim 1, wherein the plurality of pores have a size typically larger than 250 micron, and a pore shape that is a closed ellipsoidal.

18. The solidified foam bulk amorphous alloy structure described in claim 17, wherein the volume traction of the plurality of pores is in the range of 5 to 50%.

19. The solidified foam bulk amorphous alloy structure described in claim 17, wherein the volume fraction of the plurality of pores is in the range of 10 to 30%.

20. The solidified foam bulk amorphous alloy structure described in claim 17, wherein the volume fraction of the plurality of pores is in the range of 40 to 70%.

21. The solidified foam bulk amorphous alloy structure described in claim 1, wherein the plurality of pores have a size typically larger than 20 micron, and a pore shape that is a closed ellipsoidal.

22. The solidified foam bulk amorphous alloy structure described in claim 21, wherein the volume fraction of the plurality of pores is in the range of 20 to 90%.

23. The solidified foam bulk amorphous alloy structure described in claim 21, wherein the volume fraction of the plurality of pores is in the range of 50 to 80%.

24. The solidified foam bulk amorphous alloy structure described in claim 21, wherein the pore shape is spherical and the volume fraction of the plurality of pores is in the range of 20% to 70%.

25. The solidified foam bulk amorphous alloy structure described in claim 24, wherein the volume fraction of the plurality of pores is in the range of 40% to 60%.

26. The solidified foam bulk amorphous alloy structure described in claim 1, wherein the plurality of pores have a size typically less than 10 micron, and a pore shape that is a closed ellipsoidal.

27. The solidified foam bulk amorphous alloy structure described in claim 26, wherein the volume fraction of the plurality of pores is in the range of 20 to 90%.

28. The solidified foam bulk amorphous alloy structure described in claim 26, wherein the volume fraction of the plurality of pores is in the range of 50 to 80%.

29. The solidified foam bulk amorphous alloy structure described in claim 26, wherein the pore shape is spherical and the volume fraction of the plurality of pores is in the range of 20% to 70%.

30. The solidified foam bulk amorphous alloy structure described in claim 29, wherein the volume fraction of the plurality of pores is in the range of 40% to 60%.

31. The solidified foam bulk amorphous alloy structure described in claim 1, wherein the plurality of pores have an open-cellular structure.

32. The solidified foam bulk amorphous alloy structure described in claim 31, wherein the volume fraction of the plurality of pores is in the range of 40 to 95%.

33. The solidified foam bulk amorphous alloy structure described in claim 31, wherein the volume fraction of the plurality of pores is in the range of 70 to 90%.

34. The solidified foam bulk amorphous alloy structure described in claim 1, wherein the bulk solidifying amorphous alloy has a composition according to the formula $(Zr,Ti)_a(Ni,Cu, Fe)_b(Be,Al,Si,B)_o$, where a is in the range of from 30 to 75, b is in the range of from 5 to 60, and c in the range of from 0 to 50 in atomic percentages.

35. The solidified foam bulk amorphous alloy structure described in claim 34, wherein the bulk solidifying amorphous further comprises up to 20% of at least one additional transition metal.

36. The solidified foam bulk amorphous alloy structure described in claim 1, wherein the bulk solidifying amorphous alloy has a composition according to the formula $Fe_{72}Al_5Ga_2P_{11}C_6B_4$.

37. An article comprising the solidified foam bulk amorphous alloy structure described in claim 1, wherein the article has a solid thin shell on an outer surface thereof.

38. The article as described in claim 37, wherein the solid thin shell has a thickness less than 2.0 mm.

39. The article as described in claim 37, wherein the solid thin shell is one continuous piece covering the outer surface of the article.

40. The article as described in claim 37, wherein the solid thin shell has a metallurgical bond to the solidified foam bulk amorphous alloy structure.

41. A solidified foam bulk amorphous alloy structure comprising a foam structure of a bulk solidifying amorphous alloy having a critical casting thickness of about 0.5 mm or more wherein a continuous piece of the bulk solidifying amorphous alloy is connected through a pore structure comprising a plurality of pores and wherein the size of each pore is from 1 micron to up to 5.0 mm in size and the volume fraction of the plurality of pores is from 10% to up to 95% or more such that the solidified foam bulk amorphous alloy structure is superior to the monolithic solid form of the base bulk solidifying amorphous alloy in at least one of the characteristics selected from the group consisting of specific modulus, specific strength, elastic strain limit, energy absorption, fracture toughness, and crack propagation resistance.

* * * * *